US005310273A

United States Patent [19]

Hara

[11] Patent Number: 5,310,273

[45] Date of Patent: May 10, 1994

[54] JOINT FOR TRUSS STRUCTURE

[75] Inventor: Yukio Hara, Iwata, Japan

[73] Assignees: Yamaha Hatsudoki Kabushiki Kaisha, Shizuoka; Mitsui & Co., Ltd., Tokyo; Nakamura Kensetsu Kabushiki Kaisha, Sizuoka, all of Japan

[21] Appl. No.: 910,241

[22] Filed: Jul. 9, 1992

[30] Foreign Application Priority Data

Jul. 9, 1991 [JP] Japan ..... 3-193684
Jul. 9, 1991 [JP] Japan ..... 3-193686
Jul. 9, 1991 [JP] Japan ..... 3-193687

[51] Int. Cl.[5] ..... E02D 29/00

[52] U.S. Cl. ..... 403/171; 403/170; 403/176; 403/45; 403/217

[58] Field of Search ..... 403/171, 170, 169, 176, 403/44, 45, 43, 48, 217; 52/655.2, 655.1, 81.2, 648.1

[56] References Cited

U.S. PATENT DOCUMENTS 3,864,049 2/1975 Ono .
3,982,841 9/1976 Endzweig ..... 403/171
4,074,497 2/1978 Ono .
4,100,713 7/1978 Shoe ..... 403/217
4,161,088 7/1979 Gugliotta ..... 403/176
4,648,223 3/1987 Richard ..... 403/171
4,763,459 8/1988 Wesselski ..... 403/171
5,088,852 2/1992 Davister ..... 403/171

FOREIGN PATENT DOCUMENTS 2536468 2/1977 Fed. Rep. of Germany .
2299462 8/1976 France .

*Primary Examiner*—Randolph A. Reese
*Assistant Examiner*—Anthony Knight
*Attorney, Agent, or Firm*—Bacon & Thomas

[57] ABSTRACT

A joint structure for removably attaching a ball member to an end of a bar member to form a truss structure is disclosed having an engagement member attached to the ball member, which engagement member has an exterior portion extending outwardly of the outer surface of the ball member, and an attachment device associated with the end of the bar member which removably engages the exterior portion of the engagement member. The joint structure according to the present invention may be utilized with bar members with or without tension rods extending through the bar member. The ball structure may be a spherical shell made of metal or fiber reinforced plastic which is located within a hollow concrete sphere. The spherical shell is not removed from the interior of the concrete sphere, but, instead, is used to increase the tensile force resistance of the ball member. The spherical shell may be imbedded in the ball member at the time of forming the concrete ball and can be used as a molding core.

40 Claims, 7 Drawing Sheets

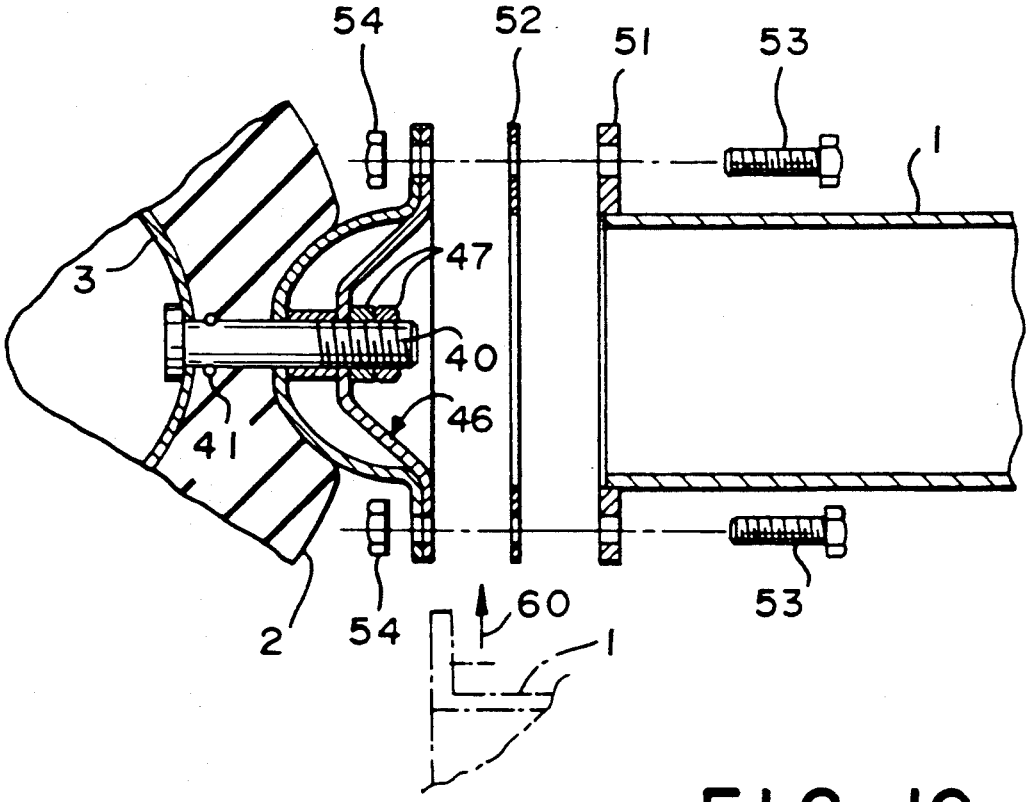
FIG. 10
FIG. 11
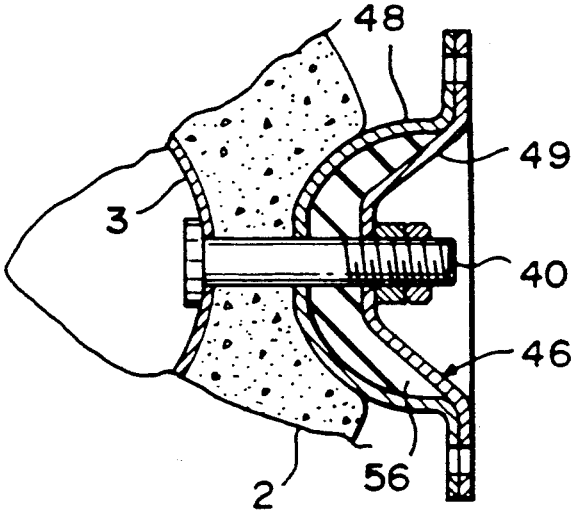

JOINT FOR TRUSS STRUCTURE

BACKGROUND OF THE INVENTION

The present invention relates to a joint for a truss structure, more particularly such a joint for removably attaching a ball member to an end of a bar member to form a truss structure.

It is known to submerge truss structures under water to form an artificial habitat for fish, or for minimizing the erosion effect of waves on the undersea terrain. Truss structures are typically made by joining a plurality of bar members together by means of concrete balls. The bar member may comprise a concrete cylinder through which a tension member, such as a tension cable, extends. The ends of the tension cable may be attached to the concrete balls at opposite ends of the bar member so that tensile forces exerted on the bar member are borne by the tension cable, while compression forces exerted thereon are borne by the concrete cylinder.

The conventional truss structure elements are difficult to assemble, since the ends of the tension member extending through the bar must be attached to the ball member. This is usually accomplished by a press fitting connection between projection members fixed on the end of the tension member which must be inserted into holes on the ball member.

Another disadvantage of the known truss joints is their poor assembly accuracy caused by the inability of the connecting mechanisms to facilitate adjusting the length of the tension member.

Additional disadvantages involve the fabrication of the concrete ball member. Since the concrete ball used in conventional truss structures is made in a hollow spherical shape to compensate for the difference in specific weights between concrete and sea water, it must be formed around a spherical core. This spherical core is extremely difficult to remove from the concrete ball member.

As is well known in the art, concrete is strong against compression forces, but is weak against tensile forces. Therefore, a concrete ball member cannot bear large tensile forces. Thus, it is quite desirable to provide a ball member having simplified construction, while at the same time increasing its strength against tensile forces.

SUMMARY OF THE INVENTION

A joint structure for removably attaching a ball member to an end of a bar member to form a truss structure is disclosed having an engagement member attached to the ball member, which engagement member has an exterior portion extending outwardly of the outer surface of the ball member, and an attachment device associated with the end of the bar member which removably engages the exterior portion of the engagement member. The joint structure according to the present invention may be utilized with bar members with or without tension rods extending through the bar member. If the bar member is made of concrete, quite obviously a tension member will be necessary in order to properly react the tension forces exerted on the bar member.

In a first embodiment, the end of the tension member physically engages a hollow tubular engagement member extending from the ball member so that the end of the bar member can be easily attached to the ball member externally of the ball member. A tension adjusting device is provided on the tension rod to adjust the tension after the rod has been engaged with the engagement member.

In a second embodiment, a nut collar is attached to the end of the tension rod and may be threaded onto the exterior portion of the engagement member. In both the first and second embodiments, a resilient device is operatively interposed between the end of the bar member and the exterior surface of the ball member to facilitate adjustment during the assembly process.

In a third embodiment, the bar member is utilized without a tension rod and is directly attached to a stop member which is, in turn, attached to the exterior portion of the engagement member.

In all of the embodiments, the ball structure may comprise a spherical shell made of metal of fiber reinforced plastic which is located within a hollow concrete sphere. The spherical shell is not removed from the interior of the concrete sphere, but, instead, is used to increase the tensile force resistance of the ball member. The spherical shell may be imbedded in the ball member at the time of forming the concrete ball and can be used as a molding core. This allows the ball to be manufactured easily and efficiently, while at the same time increases the tensile strength of the finished structure.

According to this invention, the bar member is joined to the ball member simply and efficiently by attaching the bar member to an engagement member provided on the exterior of the ball member. Since the joint structure of this invention may adjust the length of the bar member through the joint, the accuracy of assembly is increased without requiring a special length adjusting mechanism.

BRIEF DESCRIPTION OF THE DRAWINGS

FIG. 10 is an exploded, cross-sectional view of the joint structure shown in FIG. 9.

FIG. 11 is a partial, cross-sectional view illustrating a modification of the joint structure illustrated in FIG. 9.

DETAILED DESCRIPTION OF THE PREFERRED EMBODIMENTS

Figure 5:
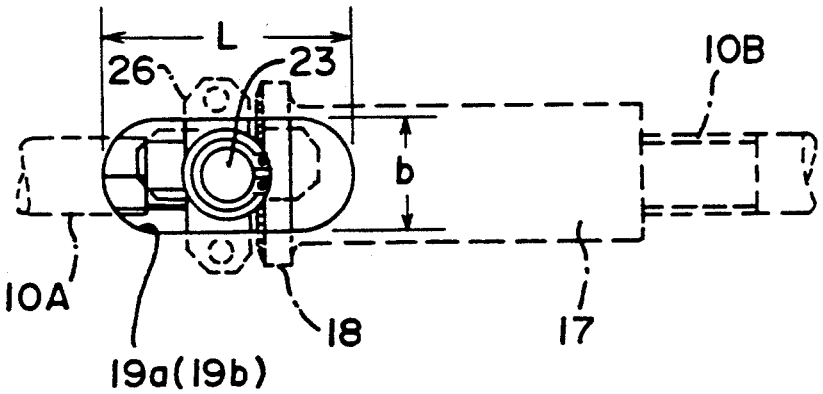
FIG. 5 is a cross-sectional view taken along line C—C in FIG. 2.
Figure 1:
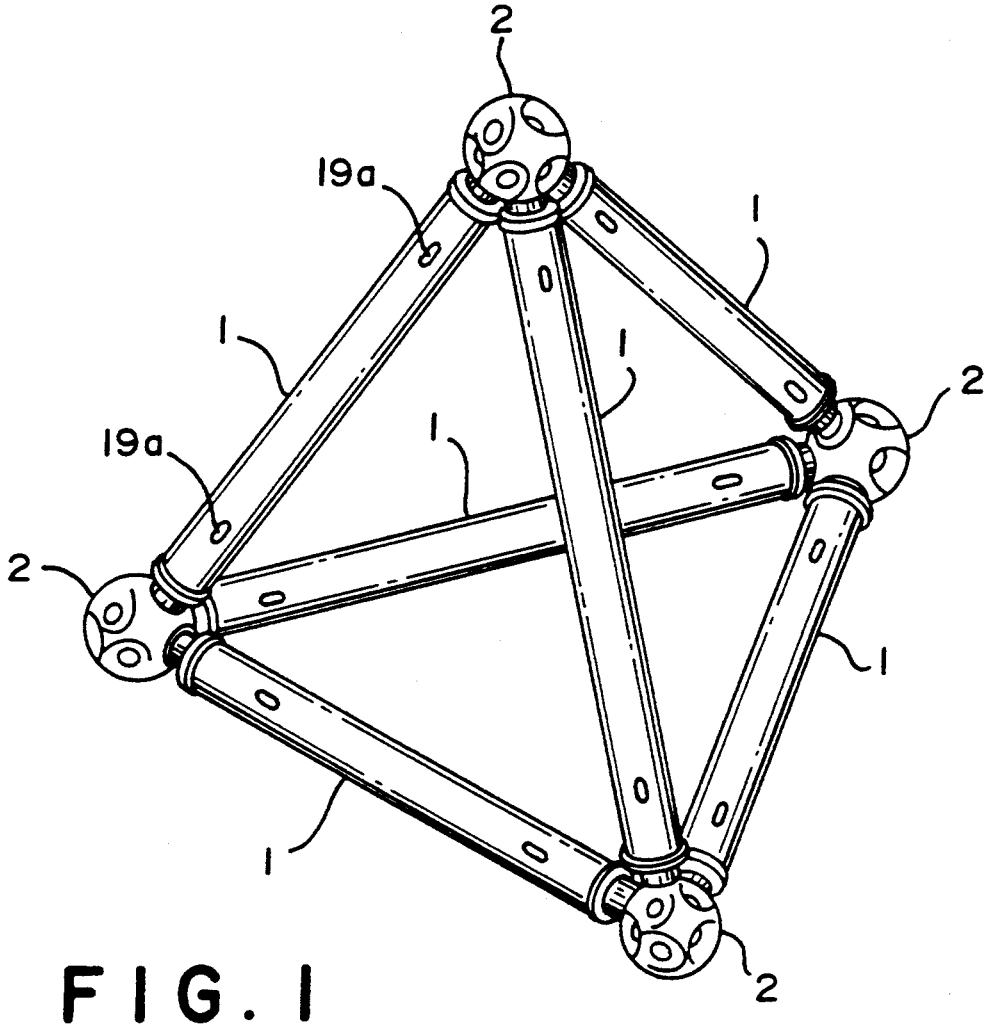
FIG. 1 is a perspective view of a truss having the joint structure according to the present invention.

FIG. 1 illustrates a basic truss unit of the truss structure according to the present invention comprising six bar members 1 joined together by means of four ball members 2 to form a three dimensional structure. A plurality of these basic truss units may be combined together to form a truss structure of virtually any desired configuration.

A first embodiment of the joint structure according to this invention is illustrated in FIGS. 2–5. The ball member 2 is a hollow concrete sphere having a spherical shell 3 imbedded therein. The spherical shell 3 may be made of metal, fiber reinforced plastic, or other materials which will increase the tensile strength of the ball member 2. The spherical shell 3 can be used as a core on which the concrete layer is molded during the fabrication of the ball member. Since the spherical shell 3 forms an integral part of the ball member 2, it need not be removed therefrom after the concrete sphere has cured.

The spherical shell 3 is provided with a plurality of engagement members which, in this particular embodiment, comprise a collar 4 having a hollow interior. The collar 4 has a portion extending exteriorly of the outer surface of the ball member 2. The outer surface of the ball member 2 may define a plurality of recesses 5 located around the exterior portions of collars 4. The outer surface may also define recesses 6 which connect the tapered recesses 5 to each other.

The spherical shell 3 may be fabricated from a pair of hemispherical portions, each portion being provided with a plurality of holes 7 through which the collars 4 extend. One end of the collar 4 is formed with a flange 4*a* which bears against the interior surface of the spherical shell 3. As the collar 4 is moved outwardly through the hole 7, flange 4*a* contacts the inner surface of the spherical shell 3. In order to hold the collar 4 in this location, a metal or rubber stop ring 8, located on an exterior surface of the collar 4 and extending outwardly therefrom is provided.

After attaching the collars 4 to the hemispherical portions of the spherical shell 3, the hemispherical portions are joined together to constitute the spherical shell 3. Using this spherical shell 3 as a core, concrete is molded around the outer surface of the spherical shell 3 to form the ball member 2.

The portion of the collar 4 extending exteriorly of the surface of the ball member 2 defines an opening 4*c* through a lateral portion thereof which communicates with the hollow interior, and an opening 4*b* formed on an end surface and extending from one side thereof so as to communicate with the lateral opening 4*c* as well as the hollow interior of the collar 4.

Figure 2:
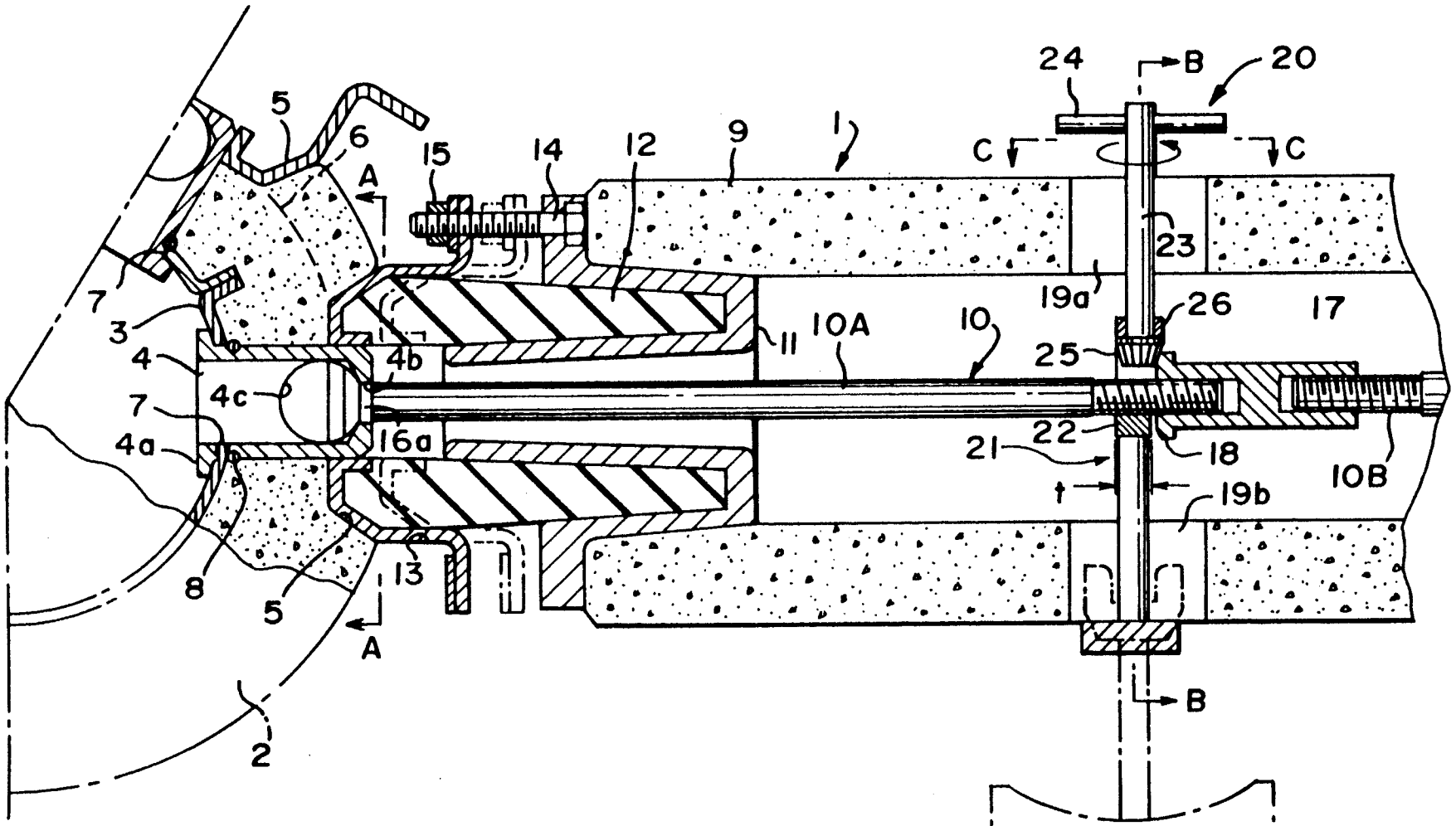
FIG. 2 is a partial, cross-sectional view of a first embodiment of the joint structure according to the present invention.
Figure 3:
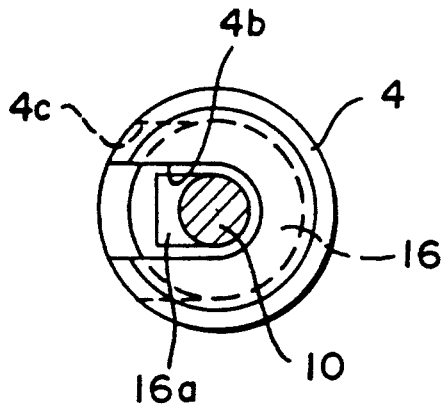
FIG. 3 is a cross-sectional view taken along line A—A in FIG. 2.

The bar member, as illustrated in FIG. 2, comprises a hollow concrete cylindrical bar 9, a metallic tension rod 10 extending through the hollow interior of the bar 9 and a socket member 11 fitted into the end of the cylindrical bar 9. A resiliently elastic member 12, made from rubber or the like, has a generally cylindrical configuration and is attached to the socket member 11. A distal end of the resilient member 12 is covered by a metallic cup member 13 which is configured to fit within a tapered recess 5 formed on the outer surface of the ball member 2. Cup member 13 and socket member 11 are fastened together by a plurality of bolts 14 and nuts 15.

Tension rod 10 has an enlarged end portion 16 formed thereon configured to pass through the opening 4*c* formed in the collar 4 and to engage an inner end portion of the collar 4. Projection 16*a* is located adjacent to the enlarged portion 16 and is configured so as to engage the opening 4*b* formed on the end surface of the collar 4 so as to prevent relative rotation between the tension rod 10 and the collar 4.

As best illustrated in FIG. 2, the tension rod 10 may be divided into rod portions 10A and 10B, respectively, and connected together by turnbuckle 17. As is well known in the art, turnbuckle 17 threadingly engages ends of rod portions 10A and 10B such that rotation of the turnbuckle relative to the rod portions causes the rod portions to either move away from each other or toward each other. Turnbuckle 17 has a bevel gear 18 formed thereon to facilitate the rotation of the turnbuckle 17 from the exterior of the bar member 1.

Figure 4:
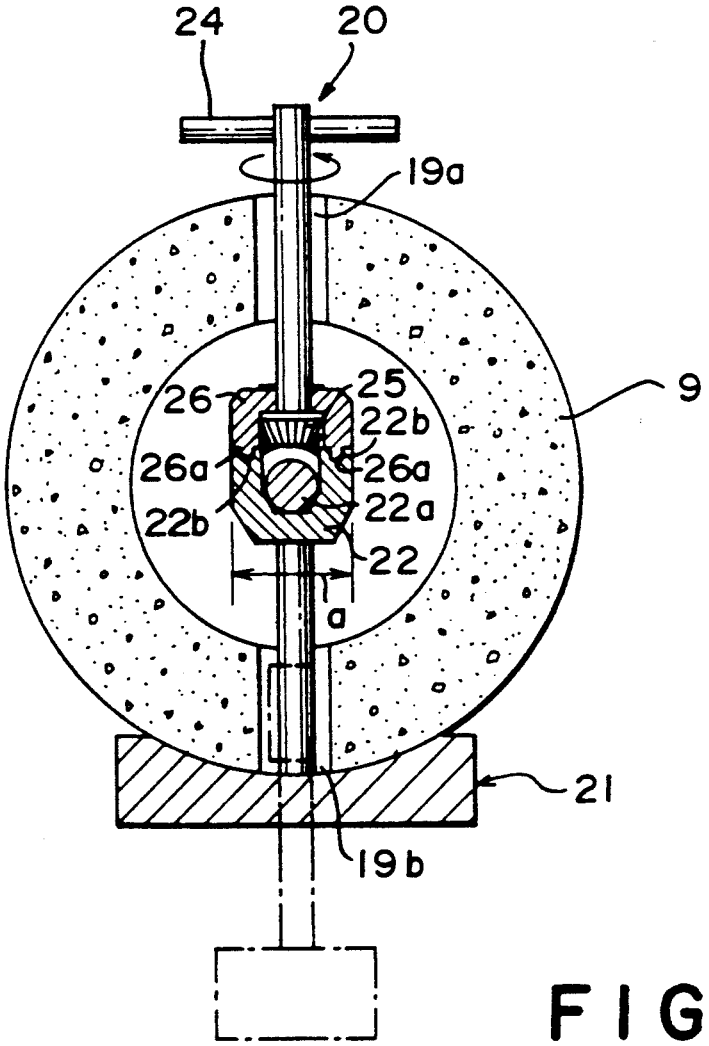
FIG. 4 is a cross-sectional view taken along line B—B in FIG. 2.

In order to rotate the turnbuckle 17, a turning tool 20 is inserted through elongated opening 19*a* formed in the concrete cylinder 9 which opening is located so as to facilitate access to the bevel gear 18. A support tool 21 is inserted through elongated opening 19*a*, located generally diametrically opposite opening 19*a*, so that the end of rod portion 10A is fitted into, and held in recess 22*a* defined by support block 22 on the support tool 21, as is best illustrated in FIG. 4. The width a of the support block 22 is less than the length of the elliptical opening 19*b* and the thickness t is less than the width of the opening 19*b* so that the support rod can be passed through this opening into the interior of the concrete cylinder 9.

Turning tool 20 comprises a shaft 23 having a handle 24 attached thereto, the end of shaft 23 being formed into a bevel gear 25 for engagement with the bevel gear 18 of the turnbuckle 17. The shaft 23 extends through a bearing member 26 having projections 26*a* for engaging corresponding recesses 22*b* formed in the top surface of the support block 22.

The dimensional relationship between the bearing member 26 and the elliptical opening 19*a* is similar to that of the dimensioned relationship between the support block 22 and the opening 19*a* previously described. Thus, the bearing member 26 may be easily inserted through the opening 19*a* and, once inserted, need be turned only 90° to be aligned with the support block 22. Once the tools are positioned as illustrated in FIGS. 2 and 4, it can be seen that rotation of shaft 23 will cause rotation of the turnbuckle 17 through the interengagement of bevel gears 18 and 25. Rotation of the rod portions is prevented by the engagement of projection 16*a* with the opening 4*b* formed in the end of collar 4. By rotating the turnbuckle 17, the overall length of the tension rod 10 may be easily adjusted.

In order to assemble the bar member 1 to the ball member 2, length of the bar member 1 is reduced by turning the nuts 15 so as to move the cup member 13 towards the socket member 11 as indicated in dashed lines in FIG. 2. This moves the distal end of the cup member 13 away from the enlarged portion 16 of the tension rod 10, thereby enabling the enlarged portion 16 to be inserted laterally through the opening 4*c* into the collar 4. The projection 16*a* engages the opening 4*b* in order to prevent rotation of the tension rod 10 relative to the collar 4.

Following this insertion, the nuts 15 are again turned so as to enable the cup member 13 to enter the tapered recess 5. The cup member 13 is urged in this direction as the nuts 15 are loosened due to the resiliency of resilient member 12. The nuts 15 and bolts 14 are then removed completely so that the tension rod 10 is held in engagement with the collar 4 by means of the compressive force of the resilient member 12. To complete the assembly, turnbuckle 17 is rotated so as to adjust the length of the tension rod 10 as necessary.

By repeating the foregoing assembly process, the truss structure may be easily assembled. In the truss structure, the tensile forces acting on the bar member 1 are borne by the tension rod 10, while compression forces are borne by the concrete cylinder 9. Impact forces acting on the truss structure are absorbed or alleviated by the resilient member 12.

By using high tensile strength materials to fabricate the spherical shell 3, the spherical shell functions as a strength member such that tensile forces act on the spherical shell so as to increase the tensile strength of the ball member 2.

Figure 6:
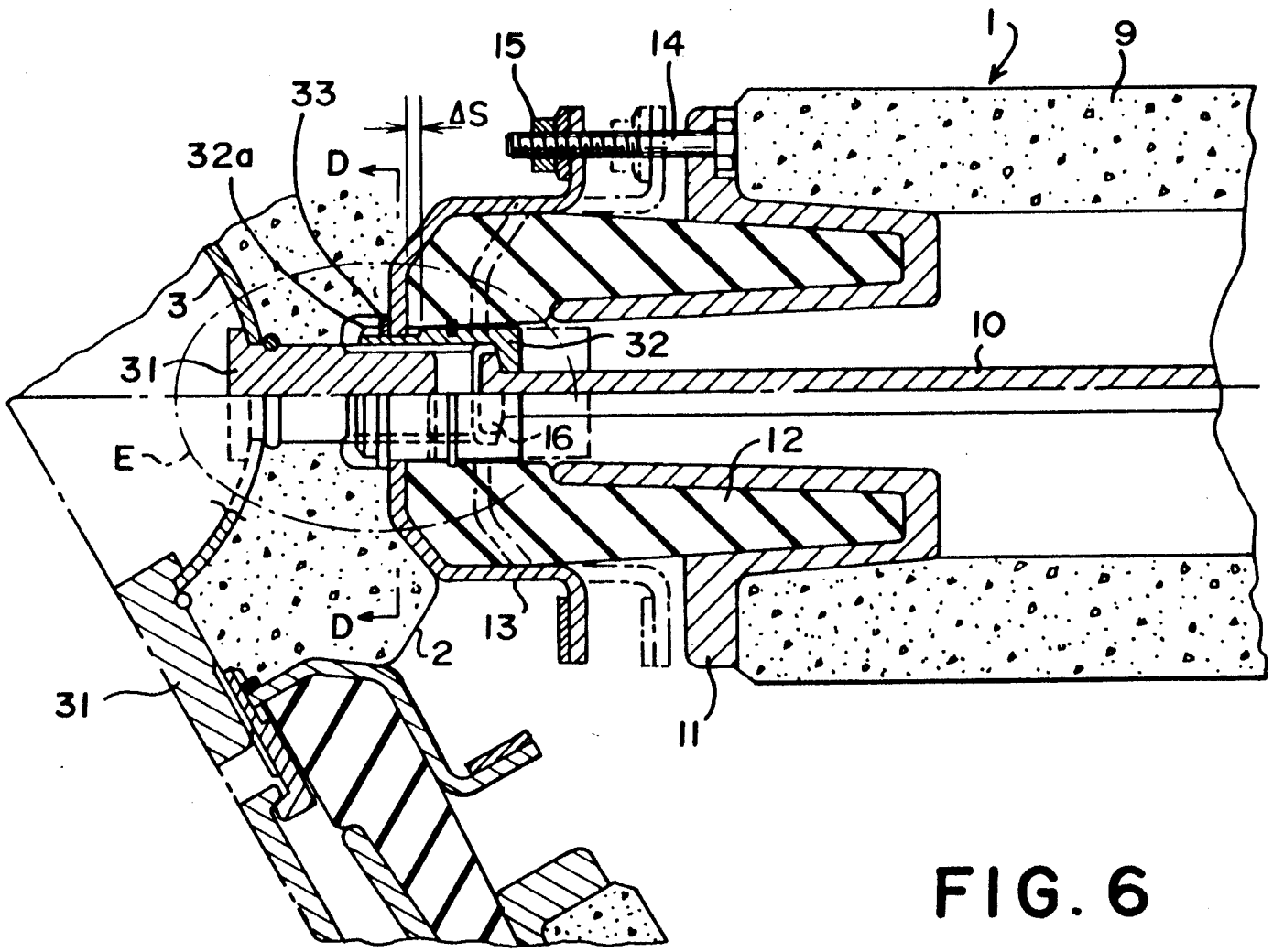
FIG. 6 is a partial, cross-sectional view of a second embodiment of the joint structure according to the present invention.
Figure 7:
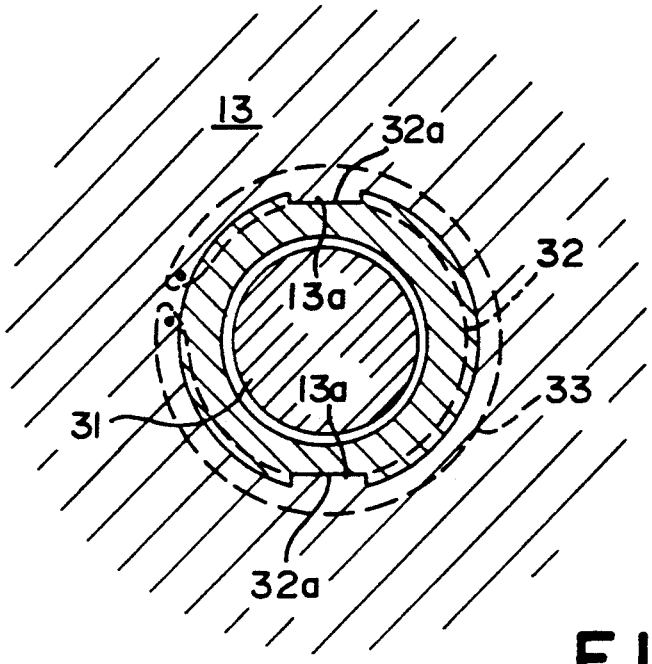
FIG. 7 is a cross-sectional view taken along line D—D in FIG. 6.
Figure 8:
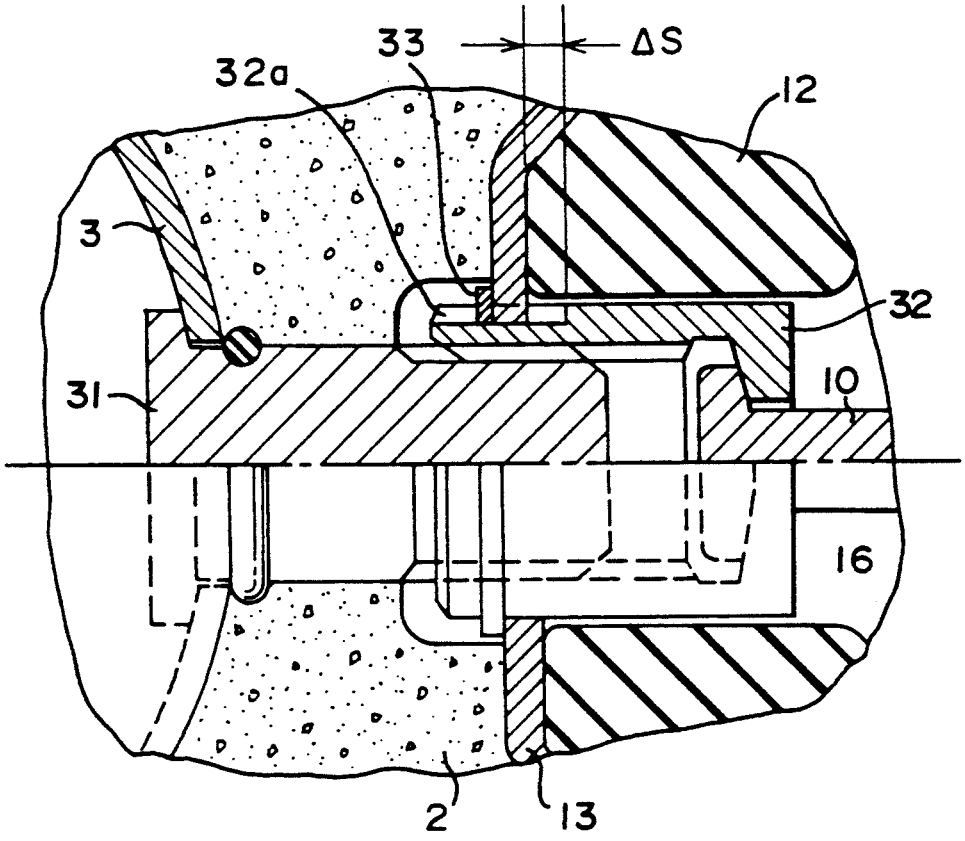
FIG. 8 is an enlarged view of area E in FIG. 6.

A second embodiment of the present invention is illustrated in FIGS. 6–8. Elements of this embodiment having the same or similar functions to those elements of the previously described embodiment have been given the same identifying numerals.

The ball member 2 is formed similarly to the ball member of the previously described embodiment wherein a spherical shell 3 is embedded in a concrete covering. However, instead of hollow, collar members 4, this embodiment utilizes a shaft member 31 attached to the spherical shell 3 by an enlarged flange and a stop ring as in the previously described embodiment. The portion of shaft member 31 extending exteriorly of the ball member 2 is threaded.

Tension rod 10 has enlarged portion 16 formed on the end thereof which portion engages nut collar 32. Nut collar 32 has a generally hollow configuration with threads formed on an internal surface adapted to engage the threads formed on the end of shaft member 31. The nut collar 32 defines, on an external surface, a pair of axially extending recesses 32*a* located generally on diametrically opposite sides of the nut collar 32, as illustrated in FIG. 7. Cup member 13 has projections 13*a* extending therefrom and located so as to slidably engage the recesses 32*a*. As can best be seen in FIG. 8, the nut collar 32 is attached to the cup member 13 with snap ring 33 which prevents the axial disengagement of these elements. The cup member 13 is capable of moving a distance $\Delta S$ relative to the nut collar 32, the distance $\Delta S$ being between a rear surface of the cup member and the end of the recesses 32*a*. Thus, while slight axial movement between the nut collar 32 and the cup member 13 is allowed, these elements must rotate together due to the interengagement of the projections 13*a* with the recesses 32*a*.

In order to assemble the elements of this embodiment, the cup member 13 is moved to the position shown in dashed lines in FIG. 6 toward the socket member 11 by tightening nuts 15 on bolts 14. After locating the bar member 1 adjacent to the ball member 2, nuts 15 are loosened enabling both the cup member 13 and the nut collar 32 to move towards the left, as illustrated in FIGS. 6 and 8. This brings the nut collar 32 into contact with the end of shaft member 31. The nuts 15 and bolts 14 are then completely removed and the cup member 13, along with the nut collar 32 are rotated to thread the nut collar 32 onto the shaft member 31. When the bar member 1 is joined to the ball member 2 in this way, the nut collar 32 can only move a distance $\Delta S$ when the cup member 13 is in contact with the ball member 2. Such continued turning movement after contact between the cup member 13 and the ball member 2 moves the nut collar 32 relative to the cup member 13 so as to adjust the tension in the tension rod 10. Thus, the length of the tension rod 10 can easily be adjusted if its length is set slightly shorter than the specified distance between the opposite ball members 2.

In this embodiment, since the spherical shell 3 is embedded in the ball member 2, it serves to reinforce the ball member against tensile forces, as in the previous embodiment.

Figure 9:
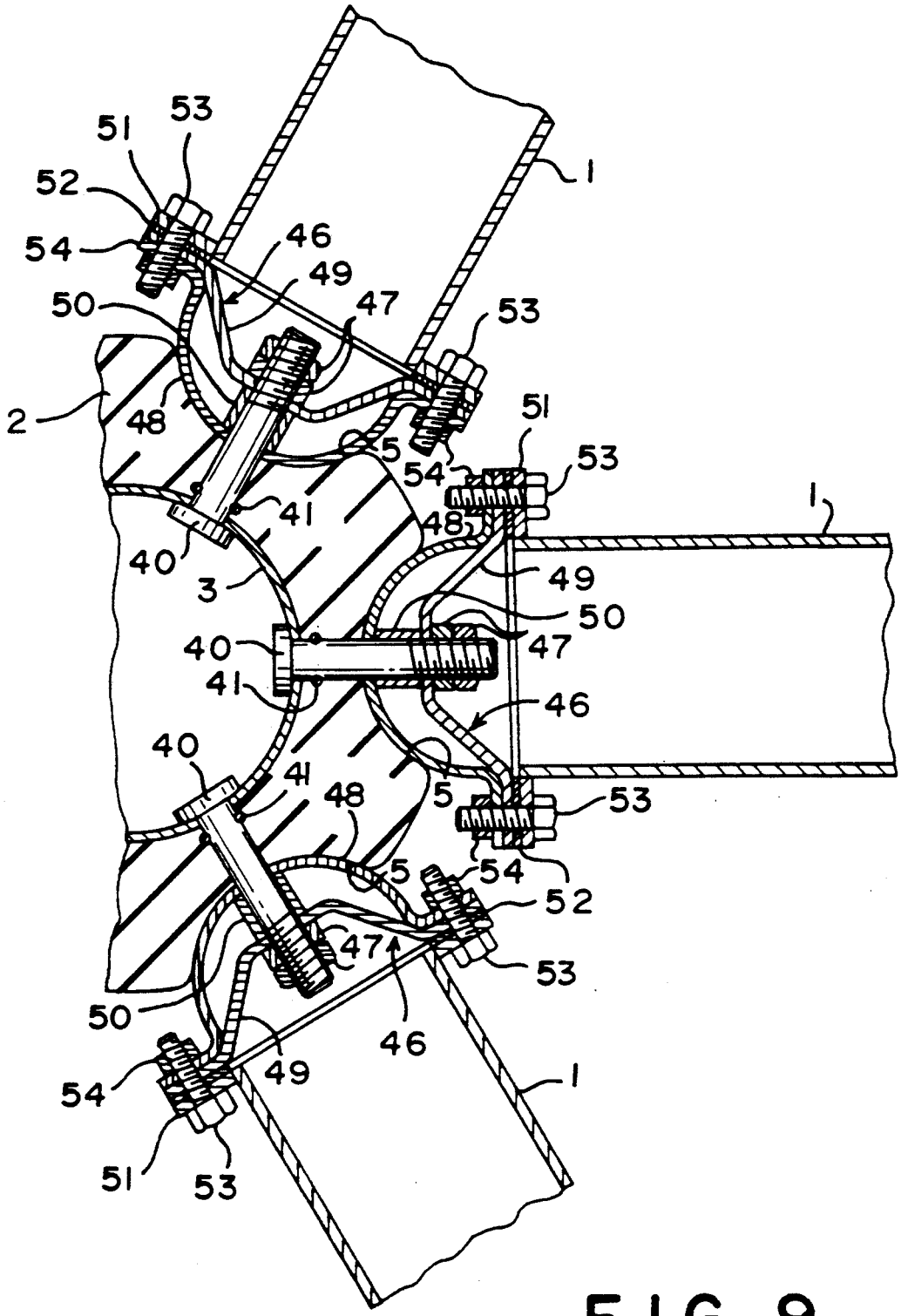
FIG. 9 is a partial, cross-sectional view of a third embodiment of the joint structure according to the present invention.

A third embodiment of the present invention is illustrated in FIGS. 9–11. Again, elements having similar functions to those in the previously described embodiments have been given the same numerals. In this embodiment, the ball member 2 comprises the inner spherical shell 3 made of metal or fiber reinforced plastic which is coated with a rubber material extending from the outer surface of the spherical shell 3.

A plurality of shaft members 40 are attached to the spherical shell 3 by enlarged heads and stop rings 41 such that a portion of the shaft member 40 extends externally of the ball member 2, which external portion has external threads thereon. The exterior surface of the rubber coating defines tapered recesses 5 surrounding the exterior portions of the shaft members 40.

A stop member 46 is attached to the exterior portions of shaft members 40 by lock nuts 47 threadingly engaged onto the shaft members 40. The stop member 46 comprises a base cup member 48 and a socket member 49, each having generally radially extending flanges. The base cup member 48 is spaced from the socket member 49 by a spacer collar 50, which may extend around a portion of shaft member 40.

In this embodiment, the bar member 1 comprises a metal pipe, such as steel, and has a flange 51 extending radially from end portions thereof.

To assemble the bar member 1 to the ball member 2 the flange 51 of the bar member is fitted onto a stop member 46 with an annular shim 52 interposed therebetween. The elements are fastened together by means of a plurality of bolts 53 passing through the flange 51, the shim 52 and the flanges of the stop member 46. Nuts 54 engage the bolts 53 in order to retain the elements together.

The center-to-center distance between ball members 2 may be adjusted by changing the thickness of the annular shim 52. This may be accomplished by either adding or subtracting shims, or using shims of different thicknesses. If a bar member 1 is to be assembled to a partially assembled truss structure, the bar member 1 need only be inserted laterally between the two ball members 2 in the direction of arrow 60 in FIG. 10. This insertion is rendered easier because the flange 51 of the bar member 1 and the flanges of the stop member 46 extend generally parallel to each other and are perpendicular to the longitudinal axis of the bar member 1.

A modified form of this embodiment is illustrated in FIG. 11 and may be utilized when the ball member 2 has the spherical shell 3 coated with a cement material, as in the previously described embodiments. In this instance, a resiliently elastic material 56, such as rubber, is interposed between the base cup member 48 and the socket member 49.

This embodiment simplifies the assembly of the truss structures by directly bolting the end of the steel bar member to a stop member secured to the ball member.

The foregoing description is provided for illustrative purposes only and should not be construed as in any way limiting this invention, the scope of which is defined solely by the appended claims.

I claim:

1. A joint structure for removably attaching a ball member having an outer surface to an end of a hollow bar member to form a truss structure comprising:

a) an engagement member fixedly attached to the ball member, the engagement member having an outer portion engageable from exteriorly of the ball member wherein the engagement member comprises a collar defining an interior space and having the outer end portion defining an opening communicating with the interior space;

b) a tension rod extending through the bar member;

c) attachment means operatively associated with the bar member and removably engaged with the outer portion of the engagement member from the exterior of the ball member so as to removably attach the ball member to the end of the bar member, wherein the attachment means comprises an enlarged end portion on an end of the tension rod adapted to enter the interior space of the collar so as to attach the tension rod to the collar; and, d) resilient means operatively extending between the end of the bar member and the ball member.

2. The joint structure of claim 1 wherein the ball member has a generally spherical shell and further comprising means to attach the engagement member to the generally spherical shell.

3. The joint structure of claim 2 wherein the generally spherical shell has a coating on an exterior surface thereof.

4. The joint structure of claim 1 wherein the resilient means comprises:

a) a socket member attached to the end of the bar member;

b) a cup member; and c) a resilient member operatively associated with the socket member and the cup member.

5. The joint structure of claim 4 further comprising means to move the cup member comprising:

a) at least one bolt attached to the socket member and having a threaded shank extending through the cup member and, b) at least one nut threadingly engaged on the threaded shank such that rotation of the nut relative to the threaded shank causes the cup member to move toward or away from the socket member.

6. The joint structure of claim 1 further comprising tension adjusting means operatively associated with the tension rod.

7. The joint structure of claim 6 wherein the tension rod comprises tension rod portions and wherein the tension adjusting means comprises a turnbuckle operatively associated with the tension rod portions such that rotation of the turnbuckle causes the tension rod portions to move toward or away from each other.

8. The joint structure of claim 7 further comprising gear means operatively associated with the turnbuckle such that rotation of the gear means causes rotation of the turnbuckle.

9. The joint structure of claim 1 wherein the engagement means comprises a shaft member attached to the ball member and having threads formed on its exterior portion.

10. The joint structure of claim 9 further comprising resilient means operatively extending between the end of the bar member and the ball member.

11. The joint structure of claim 10 wherein the resilient means comprises:

a) a socket member attached to the end of the bar member;

b) a cup member; and c) a resilient member operatively associated with the socket member and the cup member.

12. The joint structure of claim 11 further comprising means to move the cup member comprising:

a) at least one bolt attached to the socket member and having a threaded shank extending through the cup member and, b) at least one nut threadingly engaged on the threaded shank such that rotation of the nut relative to the threaded shank causes the cup member to move toward or away from the socket member.

13. The joint structure of claim 11 wherein the attachment means comprises:

a) a nut collar attached to an end of the tension rod and threadingly engaged with the exterior portion of the shaft member; and b) connecting means connecting the nut collar to the cup member such that the collar is rotatable with the cup member.

14. The joint structure of claim 13 wherein the connecting means comprises:

a) at least one slot defined by the nut collar; and, b) at least one projection extending from the cup member and located so as to be slidably received in the at least one slot such that the nut collar is axially movable with respect to the cup member.

15. A joint structure for removably attaching a ball member having an outer surface to an end of a bar member to form a truss structure comprising:

a) an engagement member attached to the ball member, the engagement member having an outer portion engageable from exteriorly of the ball member;

b) attachment means operatively associated with the bar member and removably engaged with the outer portion of the engagement member from the exterior of the ball member so as to removably attach the ball member to the end of the bar member;

c) a tension rod extending through the bar member; and, d) tension adjusting means operatively associated with the tension rod.

16. The joint structure of claim 15 wherein the ball member has a generally spherical shell and further comprising means to attach the engagement member to the generally spherical shell.

17. The joint structure of claim 16 wherein the generally spherical shell has a coating on an exterior surface thereof.

18. The joint structure of claim 15 wherein the engagement member comprises a collar defining an interior space and having the outer end portion defining an opening communicating with the interior space.

19. The joint structure of claim 18 wherein the attachment means comprises an enlarged end portion on an end of the tension rod adapted to enter the interior space of the collar so as to attach the tension rod to the collar.

20. The joint structure of claim 19 further comprising resilient means operatively extending between the end of the bar member and the ball member.

21. The joint structure of claim 20 wherein the resilient means comprises:

a) a socket member attached to the end of the bar member;

b) a cup member; and c) a resilient member operatively associated with the socket member and the cup member.

22. The joint structure of claim 24 further comprising means to move the cup member comprising:

a) at least one bolt attached to the socket member and having a threaded shank extending through the cup member and, b) at least one nut threadingly engaged on the threaded shank such that rotation of the nut relative to the threaded shank causes the cup member to move toward or away from the socket member.

23. A joint structure for removably attaching a ball member having an outer surface to an end of a bar member to form a truss structure comprising:

a) an engagement member comprising a shaft member attached to the ball member, the engagement member having an outer portion engageable from exteriorly of the ball member and having threads formed on its exterior portion;

b) attachment means operatively associated with the bar member and removably engaged with the outer portion of the engagement member from the exterior of the ball member so as to removably attach the ball member to the end of the bar member; and, c) a tension rod extending through the bar member.

24. The joint structure of claim 23 wherein the ball member has a generally spherical shell and further comprising means to attach the engagement member to the generally spherical shell.

25. The joint structure of claim 24 wherein the generally spherical shell has a coating on an exterior surface thereof.

26. The joint structure of claim 23 further comprising resilient means operatively extending between the end of the bar member and the ball member.

27. The joint structure of claim 26 wherein the resilient means comprises:

a) a socket member attached to the end of the bar member;

b) a cup member; and c) a resilient member operatively associated with the socket member and the cup member.

28. The joint structure of claim 27 further comprising means to move the cup member comprising:

a) at least one bolt attached to the socket member and having a threaded shank extending through the cup member and, b) at least one nut threadingly engaged on the threaded shank such that rotation of the nut relative to the threaded shank causes the cup member to move toward or away from the socket member.

29. The joint structure of claim 27 wherein the attachment means comprises:

a) a nut collar attached to an end of the tension rod and threadingly engaged with the exterior portion of the shaft member; and b) connecting means connecting the nut collar to the cup member such that the collar is rotatable with the cup member.

30. The joint structure of claim 29 wherein the connecting means comprises:

a) at least one slot defined by the nut collar; and, b) at least one projection extending from the cup member and located so as to be slidably received in the at least one slot such that the nut collar is axially movable with respect to the cup member.

31. A joint structure for removably attaching a ball member having an outer surface to an end of a bar member to form a truss structure comprising:

a) an engagement member comprising a shaft member attached to the ball member, the engagement member having an outer portion engageable from exteriorly of the ball member and having threads formed on its outer portion;

b) a stop member attached to the outer portion of the shaft member; and, c) attachment means operatively associated with the bar member removably engaged with the outer portion of the engagement member from the exterior of the ball member so as to removably attach the ball member to the end of the bar member wherein the attachment means comprises:

i) a flange extending from an end of the bar member; and, ii) means to removably fasten the flange to the stop member.

32. The joint structure of claim 31 wherein the ball member has a generally spherical shell and further comprising means to attach the engagement member to the generally spherical shell.

33. The joint structure of claim 32 wherein the generally spherical shell has a coating on an exterior surface thereof.

34. The joint structure of claim 33 further comprising shim means operatively interposed between the flange and the stop member.

35. The joint structure of claim 31 wherein the stop member comprises:

a) a socket member having a generally frusto-conical configuration with a first flange extending therefrom;

b) a base cup member having a generally hemispherical configuration with a second flange extending therefrom so as to contact the first flange; and, c) spacer means interposed between the socket member and the base cup member to define a space therebetween.

36. The joint structure of claim 35 further comprising an elastic material located in the space defined between the base cup member and the socket member.

37. A joint structure for removably attaching a ball member having an outer surface to an end of a bar member to form a truss structure comprising:

a) an engagement member fixedly attached to the ball member, the engagement member having an outer portion engageable from exteriorly of the ball member wherein the engagement member comprises a shaft member attached to the ball member and having threads formed on its outer portion;

b) a stop member attached to the outer portion of the shaft member; and, c) attachment means operatively associated with the bar member and removably engaged with the outer portion of the engagement member from the exterior of the ball member so as to removably attach the ball member to the end of the bar member, wherein the attachment means comprises:

i) a flange extending from an end of the bar member; and, ii) means to removably fasten the flange to the stop member.

38. The joint structure of claim 37 further comprising shim means operatively interposed between the flange and the stop member.

39. The joint structure of claim 38 wherein the stop member comprises:

a) a socket member having a generally frusto-conical configuration with a first flange extending therefrom;

b) a base cup member having a generally hemispherical configuration with a second flange extending therefrom so as to contact the first flange; and, c) spacer means interposed between the socket member and the base cup member to define a space therebetween.

40. The joint structure of claim 39 further comprising an elastic material located in the space defined between the base cup member and the socket member.

* * * * *